US007983587B2

(12) United States Patent
Imaizumi

(10) Patent No.: US 7,983,587 B2
(45) Date of Patent: Jul. 19, 2011

(54) IMAGE FORMING APPARATUS

(75) Inventor: Kei Imaizumi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 12/542,629

(22) Filed: Aug. 17, 2009

(65) Prior Publication Data

US 2010/0046998 A1 Feb. 25, 2010

(30) Foreign Application Priority Data

Aug. 19, 2008 (JP) ..... 2008-210762

(51) Int. Cl.
*G03G 15/02* (2006.01)
*G03G 15/00* (2006.01)

(52) U.S. Cl. ..... 399/100; 399/167

(58) Field of Classification Search ..... 399/99, 399/100, 167, 168, 174, 176
See application file for complete search history.

(56) References Cited

U.S. PATENT DOCUMENTS

| | | | | |
|---|---|---|---|---|
| 7,865,115 | B2 * | 1/2011 | Oguma et al. | 399/167 |
| 2007/0172251 | A1 * | 7/2007 | Suganuma et al. | 399/100 |
| 2008/0056757 | A1 * | 3/2008 | Honobe et al. | 399/100 |
| 2008/0181655 | A1 * | 7/2008 | Sakagawa et al. | 399/100 |

FOREIGN PATENT DOCUMENTS

| | | |
|---|---|---|
| JP | 8-95350 | 4/1996 |
| JP | 2002-196568 | 7/2002 |

* cited by examiner

*Primary Examiner* — Susan S Lee
(74) *Attorney, Agent, or Firm* — Canon USA Inc IP Division

(57) ABSTRACT

An image forming apparatus which includes a first image forming portion including a first photosensitive member, a first charging member for electrically charging the first photosensitive member to form an image thereon, and a first cleaning brush for cleaning the first charging member, a second image forming portion including a second photosensitive member, a second charging member for electrically charging the second photosensitive member to form an image thereon, and a second cleaning brush which has a longer brush length than that of the first cleaning brush for cleaning the second charging member, a driven mechanism for causing the first cleaning brush to be rotatably driven by the first charging member which is rotatably driven along with rotation of the first photosensitive member, and a drive coupling mechanism configured to drivably couple the second charging member and the second cleaning brush to transmit a driving force from the second charging member which is rotatably driven along with the rotation of the first photosensitive member to the second cleaning brush.

4 Claims, 7 Drawing Sheets

IMAGE FORMING APPARATUS

BACKGROUND OF THE INVENTION

1. Field of the Invention

The present invention relates to an image forming apparatus using an electrophotographic method, and particularly relates to an image forming apparatus such as a copying machine, a printer, a facsimile machine and the like.

2. Description of the Related Art

Conventionally, an electrophotographic process used in an electrophotographic image forming apparatus includes a charging step for uniformly charging a photosensitive member.

In a charging apparatus which performs the charging step, as a rotatable charging member, for example, a charging roller is in contact with the photosensitive member, and is rotatably driven by the photosensitive member. By applying a charging bias on the charging roller, a surface of the photosensitive member can be uniformly charged.

Since the charging roller is charged by contacting the photosensitive member on which a toner image is formed, a slight amount of a toner or an external additive adheres to the charging roller. If the toner and external additive accumulate on the surface of the charging roller by repetition of image formation, a situation may arise where the charging step cannot be suitably performed. More specifically, if such a situation is left as is, a life of the charging apparatus cannot be extended.

Japanese Patent Application Laid-Open No. 8-95350 discusses an apparatus which is directed to resolving this problem by cleaning the charging roller with a rotating brush which serves as a cleaning rotating member.

More specifically, by pressing the rotating brush toward the charging roller by a spring, the rotating brush obtains a driving force from traction with the charging roller surface and rotates. By employing such a configuration, the drive mechanism of the rotating brush can be simplified, and costs can be reduced.

The apparatus discussed in Japanese Patent Application Laid-Open No. 8-95350 employs a method in which the rotating brush obtains the driving force from the charging roller surface, such that the rotating brush is firmly pushed against the charging roller.

However, for the apparatus discussed in Japanese Patent Application Laid-Open No. 8-95350, deformation of a fiber portion of the rotating brush tends to increase during repeated image formation. Further, because the fiber portion deformation is not uniform in a longitudinal direction of the rotating brush, uneven contact occurs between the rotating brush and the charging roller in the longitudinal direction. This phenomenon is significant when a fiber length of the rotating brush is long, and cannot be ignored.

If peripheral speed of the rotating brush fluctuates due to such uneven contact, a "relationship between the peripheral speed of the rotating brush and the peripheral speed of the charging roller" which is predetermined so that cleaning performance by the rotating brush is suitable, breaks down.

As a result, the rotating brush can no longer suitably clean the charging roller and causes cleaning defects.

To prevent the peripheral speed fluctuation of the rotating brush, as one method, a driving force is externally input so that the rotating brush rotates at a certain peripheral speed. However, even if this method is employed, the above-described problem still cannot be resolved.

The reason for this is that since the charging roller is rotatably driven along with the rotation of the photosensitive member by obtaining the driving force from the surface of the photosensitive member, the charging roller may slip on the photosensitive member for some reason and the peripheral speed of the charging roller fluctuates.

Thus, the "relationship between the peripheral speed of the rotating brush and the peripheral speed of the charging roller" which is predetermined so that the cleaning performance by the rotating brush is suitable breaks down, and the cleaning defects may occur.

SUMMARY OF THE INVENTION

The present invention is directed to an image forming apparatus which simplifies a drive mechanism of a first rotatable cleaning member which cleans a first rotatable charging member, and which can suitably clean a second rotatable charging member by a second rotatable cleaning member over a long duration.

According to an aspect of the present invention, an image forming apparatus includes a first image forming portion including a first photosensitive member, a first charging member configured and positioned to electrically charge the first photosensitive member to form an image on the first photosensitive member, and a first cleaning brush configured and positioned to clean the first charging member, a second image forming portion including a second photosensitive member, a second charging member configured and positioned to electrically charge the second photosensitive member to form an image on the second photosensitive member, and a second cleaning brush, which has a longer brush length than a brush length of the first cleaning brush configured and positioned to clean the second charging member, a driven mechanism configured to cause the first cleaning brush to be rotatably driven by the first charging member which is rotatably driven along with rotation of the first photosensitive member, and a drive connecting mechanism configured to drivably couple the second charging member and the second cleaning brush to transmit a driving force from the second charging member which is rotatably driven along with the rotation of the first photosensitive member to the second cleaning brush.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

A first exemplary embodiment according to the present invention will be described in detail.

Figure 1:
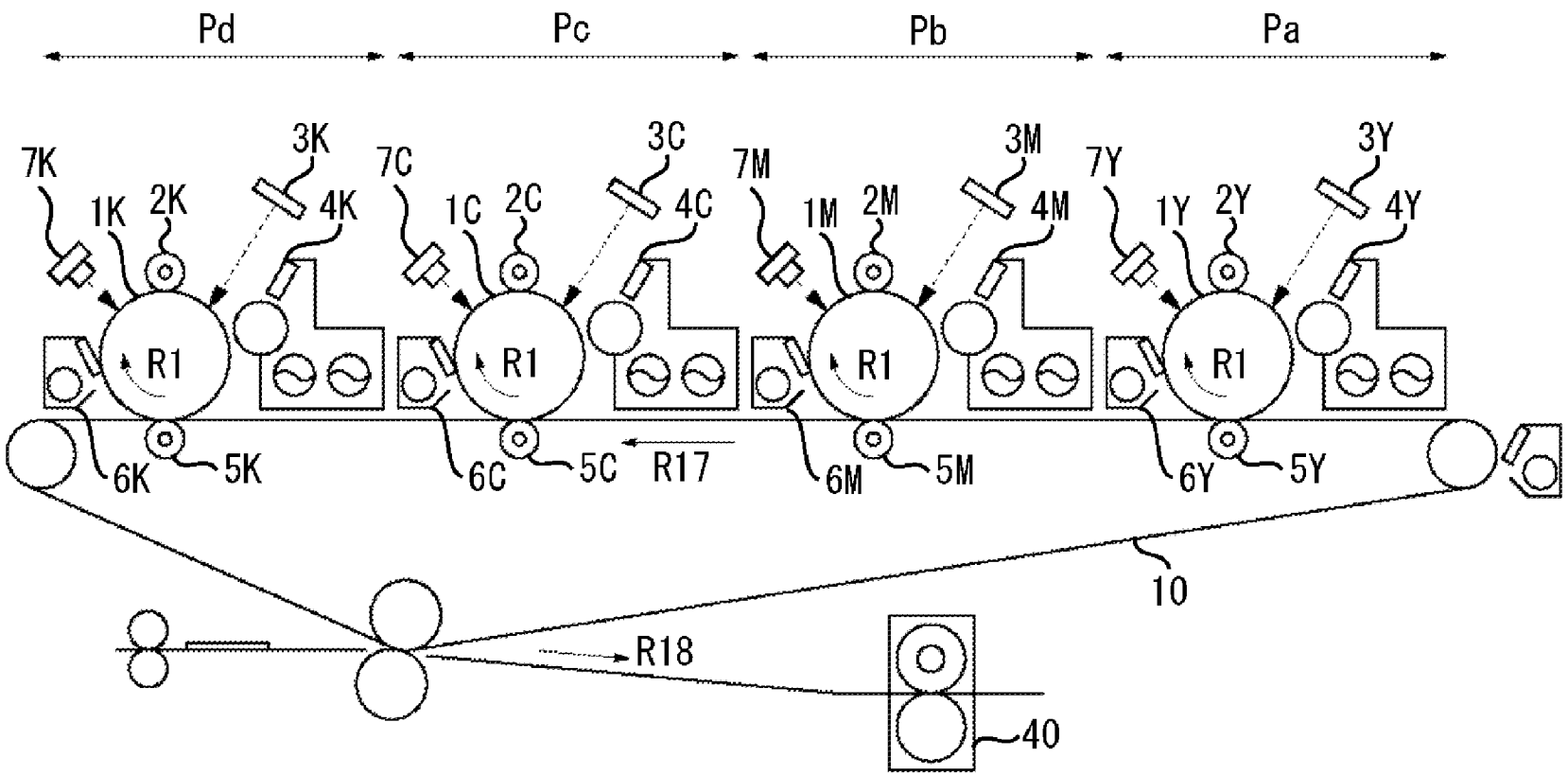
FIG. 1 is a schematic cross-sectional view of an image forming apparatus.

A schematic configuration of an image forming apparatus employing an electrophotographic method illustrated in FIG. 1 will be described. FIG. 1 is a schematic cross-sectional view of the image forming apparatus.

The image forming apparatus of the present exemplary embodiment is a tandem type full-color image forming apparatus having four drum type photosensitive members as an image carrier.

In the image forming apparatus, four image forming portions Pa, Pb, Pc, and Pd are arranged. The image forming portions Pa, Pb, Pc, and Pd respectively form a toner image in colors of yellow, magenta, cyan, and black.

Each of the image forming portions Pa, Pb, and Pc has roughly the same configuration. The image forming portion Pa will be described as an example using FIG. 2, and a detailed description of the other image forming portions Pb and Pc will be omitted. Further, the image forming portion Pd which has a slightly different configuration will be described below. However, in the description of the image forming portion Pd, the parts which are the same as the image forming portion Pa are given the same reference numerals, and thus a detailed description of such parts will be omitted.

Figure 2:
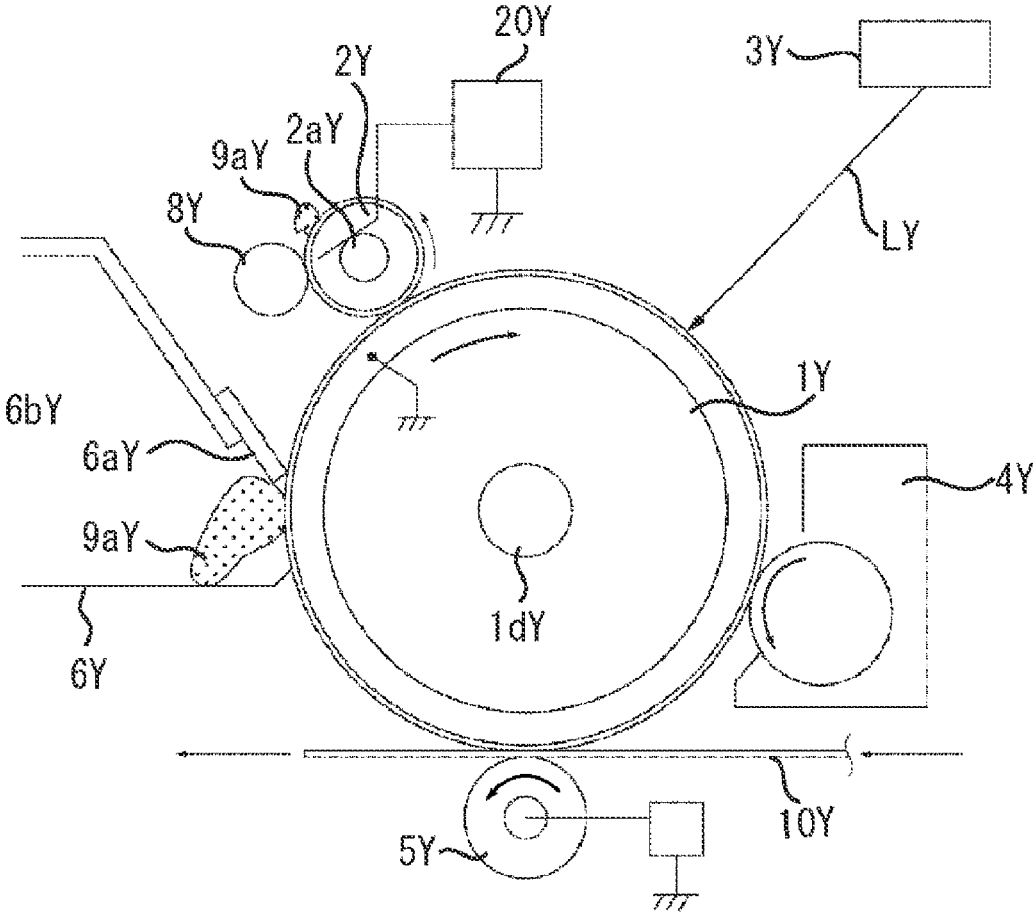
FIG. 2 is an expanded cross-sectional view of an image forming portion.

FIG. 2 is a schematic cross-sectional view of the image forming portion Pa. A photosensitive member 1Y is a member that is to be charged. The photosensitive member 1Y is an organic photosensitive member which is formed by successively laminating a photosensitive layer of an organic substance and a surface protection layer on a conductive supporting member. The surface protection layer includes fluororesin fine particles. The photosensitive member 1Y of the present exemplary embodiment uses 1 mm-thick aluminum as the conductive supporting member, and has an outer diameter of 30 mm when the photosensitive layer and the surface protection layer are laminated on the conductive supporting member.

Further, the photosensitive member 1Y obtains a driving force from a motor 1*m*Y (FIG. 3) to rotate at a predetermined peripheral speed in a direction of an illustrated arrow around a rotational shaft 1*d*Y.

A charging roller 2Y serving as a rotatable charging member is arranged on and in contact with the photosensitive member 1Y. The charging roller 2Y contacts the photosensitive member 1Y to uniformly charge the surface of the photosensitive member 1Y to a predetermined potential.

The charging roller 2Y has a conductive cored bar 2*a*Y, which serves as a shaft, as a base. An elastic layer is provided on the conductive cored bar 2*a*Y.

The conductive cored bar 2*a*Y may be formed from a metal material such as iron, copper, stainless steel, and aluminum. In the present exemplary embodiment, aluminum is used. Further, the conductive cored bar 2*a*Y may be subjected to a plating treatment to develop corrosion resistance and scratch resistance as long as conductivity is not lost.

Considering deflection which occurs when pressure is applied on the photosensitive member 1Y, the elastic layer of the charging roller 2Y is subjected to a grinding process to have a crown shape in which a center portion in the longitudinal direction is thick and both ends in the longitudinal direction are thinner. This is because both ends in the longitudinal direction of the charging roller 2Y receive a predetermined pressure from a pressing mechanism towards the photosensitive member 1Y. More specifically, the elastic layer of the charging roller 2Y has the crown shape to prevent a tendency of the contact pressure on the photosensitive member 1Y at the center portion in the longitudinal direction of the charging roller 2Y, which is smaller than that at both ends.

Further, the elastic layer of the charging roller 2Y is formed by dispersing carbon black as a conductive agent into a rubber (ethylene-propylene-diene rubber (EPDM)) as an elastic material to have conductivity such that resistance is adjusted to less than $10^{10}$ (Ωcm). Electron-conducting type substances such as graphite and conductive metal oxides, and ion-conducting type substances such as alkali metal salts and the like may be used as the conductive agent. Further, elastic materials which may be used include natural rubber, synthetic rubbers such as styrene-butadiene rubber (SBR), silicon rubber, urethane rubber, epichlorohydrin rubber, isoprene rubber (IR), butadiene rubber (BR), nitrile butadiene rubber (NBR), and chloroprene rubber (CR), polyamide resins, polyurethane resins, and silicon resins.

Therefore, the charging roller 2Y of the present exemplary embodiment has the conductive cored bar 2*a*Y with a diameter of 8 mm, a resistance adjusted to $1\times10^{6}$ (Ωcm) by adding the conductive agent to the elastic material, and an outer diameter of 14 mm.

A power source 20Y which serves as a bias application device for applying a charging bias to the conductive cored bar 2*a*Y is connected to the charging roller 2Y. The power source 20Y can apply an oscillating voltage in which a direct current (DC) voltage and an alternate current (AC) voltage are superimposed. As the charging bias, a −600 V DC voltage and an AC voltage with a peak-to-peak voltage of 1,700 V are superimposed in the present exemplary embodiment. Therefore, the photosensitive member 1Y is uniformly charged to −600 V.

Figure 5:
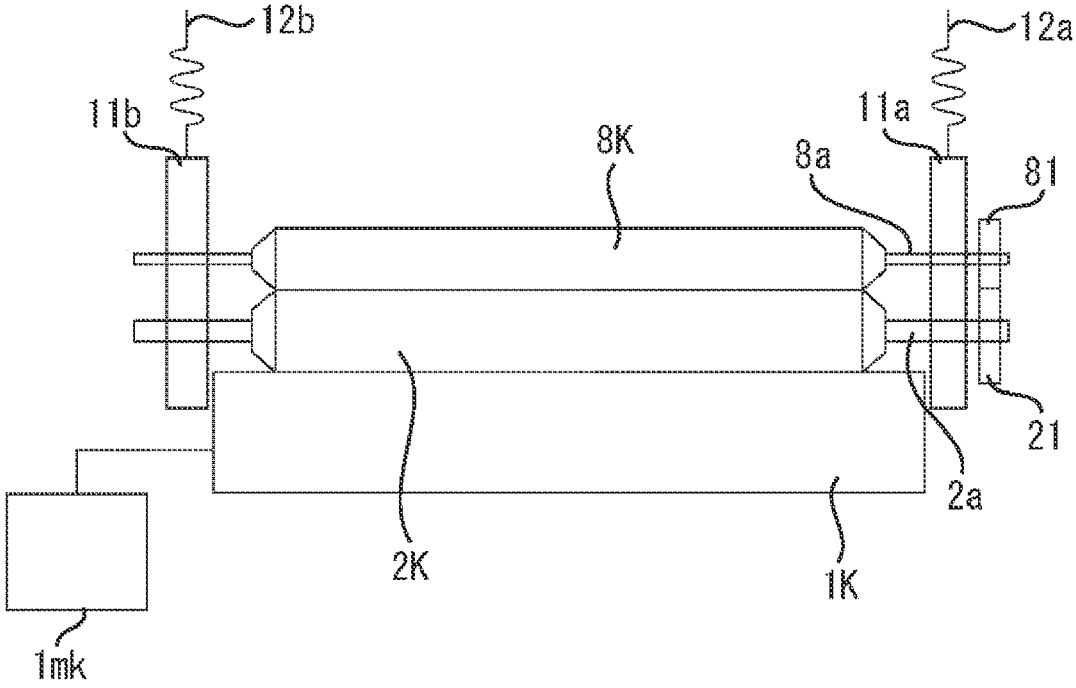
FIG. 5 is a schematic cross-sectional view illustrating a charging apparatus of the image forming portion.

Further, as illustrated in FIG. 5, in the charging roller 2Y, both ends of the conductive cored bar 2*a*Y are rotatably supported on bearing members 11*a*Y and 11*b*Y. The charging roller 2Y is pressed with a predetermined pressure pushing against the photosensitive member 1Y by pressing mechanisms 12*a*Y and 12*b*Y. More specifically, a system, the charging roller 2Y is rotatably driven along with the rotation of the photosensitive member 1Y.

As illustrated in FIGS. 1 and 2, arranged around the photosensitive member 1Y are an image exposure device 3Y, a development device 4Y, a transfer device 5Y, a cleaning device 6Y, and an optical discharging device 7Y. Further, an intermediate transfer member 10 is arranged so as to be sandwiched by the photosensitive member 1Y and the transfer device 5Y.

In the present exemplary embodiment, the image forming apparatus is configured, considering that the image forming portion Pd for forming a black toner image (monochrome image) is used more frequently than the image forming portions Pa to Pc for forming a yellow toner image, a magenta toner image, or a cyan toner image (color images).

Specifically, based on the fact that the frequency of forming a monochrome image (achromatic image) is higher than the frequency of forming a color image (chromatic image), the image forming portion Pd is designed to have a longer life than the other image forming portions.

More specifically, an organic photosensitive member having a surface layer formed from a UV-cured resin is used as the photosensitive member 1K of the image forming portion Pd. Thus, the surface layer formed on the photosensitive member 1K of the image forming portion Pd is harder than the surface layer formed on the photosensitive members Pa to Pc and suitable for extending the life of the photosensitive member 1K. Further, an inorganic photosensitive member formed from amorphous silicon may be used as the photosensitive member 1K used in the image forming portion Pd. A charging roller 2K, an image exposure device 3K, a development device 4K, a transfer device 5K, a cleaning device 6K, and a optical discharging device 7K arranged around the photosensitive member 1K are the same as the corresponding devices described as to the image forming portion Pa above.

Next, the image forming process performed by the image forming portions Pa to Pd will be described. The image forming process performed by the image forming portions Pa to Pd is roughly the same. The photosensitive member 1Y is rotated by the motor 1*m*Y. The surface of the photosensitive member 1Y is roughly uniformly charged to a predetermined polarity potential (−600 V) by a charging bias applied on the charging roller 2Y. Further, the photosensitive member 1Y charged by the charging roller 2Y is exposed to image exposure light LY from the image exposure device 3Y based on image information and an electrostatic latent image is formed thereon.

Then, the electrostatic latent image formed on the photosensitive member 1Y is visualized with negatively charged toner by the development device 4Y. The toner includes a predetermined amount of an external additive, such as silica. Next, this yellow toner image is electrostatically primarily transferred onto an intermediate transfer member 10 by the transfer device 5Y.

Such an image forming process is similarly performed by the image forming portions Pb to Pd, so that ultimately the yellow toner image, magenta toner image, cyan toner image, and black toner image are transferred and superimposed onto the intermediate transfer member 10. Then, the full color toner image on the intermediate transfer member 10 is collectively secondarily transferred onto a sheet, which is a recording material.

The full color toner image transferred onto the sheet is heated and pressed by a fixing device 40 and fixed to the sheet. Then, the sheet is discharged out of the apparatus, and the series of image forming processes is finished.

After the primary transfer, transfer residual toner remaining on the photosensitive member 1Y is removed by a cleaning blade 6*a*Y arranged on the cleaning device 6Y illustrated in FIG. 2, and is collected in a toner collecting container 6*b*Y. Then, the photosensitive member 1Y is discharged by the optical discharging device 7Y, and is ready for the next image formation.

Such a cleaning step and optically discharging step are similarly performed by the image forming portions Pb to Pd, and the photosensitive members 1M to 1K are made ready for the next image formation.

Next, using FIGS. 2 and 3, cleaning mechanism of the charging roller will be described. Since the image forming portions Pa to Pc have the same configuration as their cleaning mechanisms, the image forming portion Pa will be described as an example, and a detailed description of the image forming portions Pb and Pc will be omitted. The cleaning mechanism of the charging roller for the image forming portion Pd is different from that of the image forming portions Pa to Pc, and thus its configuration will be described following the description of the mechanism which cleans the charging roller in the image forming portion Pa.

First, the cleaning mechanism of the charging roller in the image forming portion Pa will be described. In the above-described image forming process, dust 9*a*Y such as the transfer residual toner and external additive on the photosensitive member 1Y slips past the cleaning blade 6*a*Y, and adheres to and soils the charging roller 2Y. The dust causes uneven charging, and can become a cause for image defects.

In the present exemplary embodiment, to remove the dust 9*a*Y, a cleaning brush 8Y is provided as a rotatable cleaning member for cleaning the charging roller 2Y. The cleaning brush 8Y of the present exemplary embodiment has many bristles (fibers) on the cored bar.

For the cleaning brush 8Y serving as a first rotatable cleaning member having a first brush, a brush is used which is formed from nylon fibers having a diameter of 0.8 denier (d) and a pile length of 0.5 mm. The below-described tip force is 0.8 gf/mm (i.e., 8,000 N/m). Further, the cleaning brush 8Y is arranged such that a position advanced by 45° on the rotation direction in a downstream side of the charging roller 2Y from an apex position of the charging roller 2Y (position 1800 from the contact point with the photosensitive member 1Y) is the cleaning position.

Next, the cleaning mechanism of the charging roller 2K of the image forming portion Pd will be described using FIG. 5. The image forming portion Pd also employs a configuration in which a cleaning brush 8K as a second rotatable cleaning member cleans the charging roller 2K. However, as will be described below, the cleaning brush 8K has a different configuration from that of the cleaning brushes 8Y to 8C.

More specifically, since the photosensitive member 1K of the image forming portion Pd has longer life than the photosensitive members 1Y to 1C, the charging roller 2K also needs to have a longer life. Accordingly, the configuration of the cleaning brush 8K is different from that of the cleaning brushes 8Y to 8C of the image forming portions Pa to Pc. In other word, cleaning performance of the cleaning brush 8K of the image forming portion Pd is higher than that of the cleaning brushes 8Y to 8C of the image forming portions Pa to Pc.

More specifically, the bristles (fibers) of the cleaning brush 8K may have a thickness of 1 to 10 (d (denier)), and especially a thickness of 3 to 6 (d). Further, the bristles (fibers) may have a density of 5 (10,000 filaments/inch$^2$) or more to 60 (10,000 filaments/inch$^2$) or less, and especially a density of 10 (10,000 filaments/inch$^2$) or more to 30 (10,000 filaments/inch$^2$) or less. Still further, desirable materials for the bristles (fibers) include polyethylene terephthalate (PET), acrylic, rayon, nylon, synthetic fibers and the like.

In view of the above circumstances, in the present exemplary embodiment, a nylon fiber cleaning brush 8K is used which has a bristle (fiber) thickness of 3 (d), a bristle (fiber) density of 30 (10,000 filaments/inch$^2$), and a bristle (fiber) length of 2.8 mm. Further, the intrusion amount of the cleaning brush 8K into the charging roller 2K as a second rotatable charging member is 0.8 mm. In other word, the brush length (fiber length) of the cleaning brush 8K is set to be much longer than the cleaning brushes 8Y, 8M, and 8C.

Further, for reasons described below, the tip force of the cleaning brush 8K against the charging roller 2K is set to 0.61 gf/mm (i.e., 6,100N/m). Therefore, since the cleaning brush 8K has a longer brush length (fiber length) and a greater tip force than the cleaning brushes 8Y to 8C, the cleaning brush 8K has a high cleaning performance. However, although the cleaning brush 8K has these advantageous points, because the brush length is long, the brush is more easily permanently deformed. Because of this disadvantage, as described below, a drive coupling mechanism is employed as the drive mechanism of the cleaning brush 8K, rather than a driven mechanism. This is because the intrusion amount of the cleaning brush 8K into the charging roller 2K does not have to be overly large.

Next, results of a verification performed using an index "tip force" will be described. The tip force corresponds to the cleaning performance of the brush.

The "tip force" is measured as follows. Further, the tip force is determined based on parameters unique to the cleaning brush 8K, such as the material, pile length (brush length), bristle implant density, denier which is the weight per fixed length of a filament, and a bristle implant method of the cleaning brush 8K.

Figure 4:
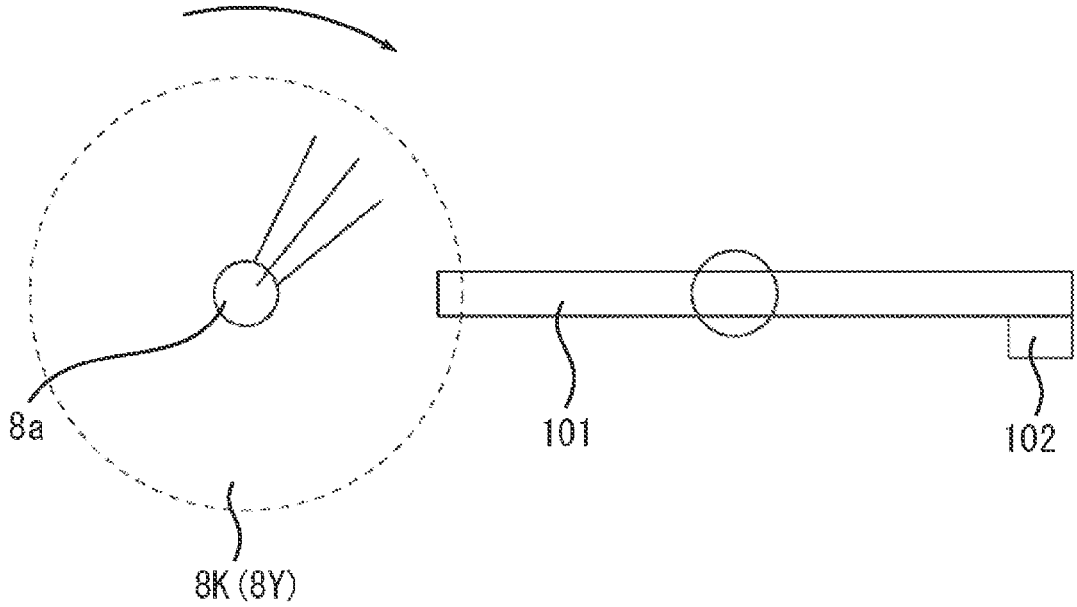
FIG. 4 illustrates a measurement system of leading edge force.

As illustrated in FIG. 4, an aluminum plate 101 was prepared with a width (the length in the direction orthogonal to the paper surface of FIG. 4) of 60 mm, a depth (the length in the horizontal direction of FIG. 4) of 100 mm, and a thickness (the length in the vertical direction in FIG. 4) of 1 mm. The aluminum plate 101 is rotatably supported at a center portion thereof. A load cell 102 is arranged in the same direction as the rotation direction of the cleaning brush 8K, on a lower surface of an edge portion of the aluminum plate 101 opposite to the cleaning brush 8K in the depth direction.

The load cell 102 detects a weight applied to the aluminum plate 101 when the cleaning brush 8K interferes with the aluminum plate 101 by intruding a fixed amount thereon, and rotates at a peripheral speed of 246 mm/sec. The tip force is defined as a value obtained by dividing the detected applied weight by the 60 mm width of the aluminum plate 101, that is, as a value per unit length in the width direction.

The tip force value is equivalent to force applied in the tangential direction to the charging roller 2K when the cleaning brush 8K cleans the charging roller 2K.

Table 1 illustrates the respective values of the tip force when setting conditions of the cleaning brush 8K were variously changed. Table 1 also indicates whether an image defect occurred after image output onto 5000 sheets. In an "Image" column, a cross (x) means that an image density defect caused by faulty charging occurred, and a circle (○) means that an image density defect caused by faulty charging did not occur.

TABLE 1

| Material | Denier | Density (10,000 filaments/ inch$^2$) | Pile Length (mm) | Intrusion Amount During Measurement (MM) | Tip Force (gf/ mm) | Image |
|---|---|---|---|---|---|---|
| Nylon | 1 | 30 | 2.8 | 1.0 | 0.07 | x |
| | 3 | 10 | 2.8 | 1.0 | 0.19 | ○ |
| | | 30 | 1.7 | 0.6 | 0.81 | x |
| | | | | 0.8 | 1.10 | x |
| | | | 2.8 | 0.6 | 0.30 | ○ |
| | | | | 0.8 | 0.41 | ○ |
| | | | | 1.0 | 0.51 | ○ |
| | | 60 | 2.8 | 0.6 | 0.61 | ○ |
| | | | | 0.8 | 0.82 | x |
| | 6 | 30 | 2.8 | 0.6 | 1.15 | x |
| Poly- | 3 | 30 | 1.7 | 0.6 | 1.40 | x |
| ester | | 30 | 2.8 | 0.6 | 0.41 | ○ |
| | | | | 1.0 | 0.92 | x |

From these results, it can be seen that the tip force of the cleaning brush 8K is desirably set to 0.19 gf/mm or more to 0.61 gf/mm or less. Stated another way, the tip force of the cleaning brush 8K is desirably set to 1,900 N/m or more to 6,100 N/m or less. In the present exemplary embodiment, as described above, the various conditions, such as the material of the cleaning brush 8K, are set such that the tip force satisfies this range.

Next, using FIG. 3, the cleaning brush drive mechanism will be described. Since the configuration of the cleaning brush drive mechanisms of the image forming portions Pa to Pc are roughly the same, the image forming portion Pa will be described as an example, and a detailed description of the image forming portions Pb and Pc will be omitted. However, the configuration of the cleaning brush drive mechanism of the image forming portion Pd is different from that of image forming portions Pa to Pc, and thus its configuration will be described following the description of the image forming portion Pa.

If the cleaning brush is rotationally driven by the charging roller, the peripheral speed of the cleaning brush tends to become unstable due to permanent deformation of the cleaning brush. However, this driven configuration, in which the brush is driven, is simple, and thus there is a benefit in terms of costs. On the other hand, if the cleaning brush is rotated by a gear coupling with the charging roller, the peripheral speed of the cleaning brush tends to be stable. However, this configuration is more complex than the driven configuration, and thus costs are increased. Therefore, in the present exemplary embodiment, two kinds of drive mechanism are employed, that is, a driven mechanism for the cleaning brushes 8Y to 8C, and a drive coupling mechanism for the cleaning brush 8K.

Figure 3:
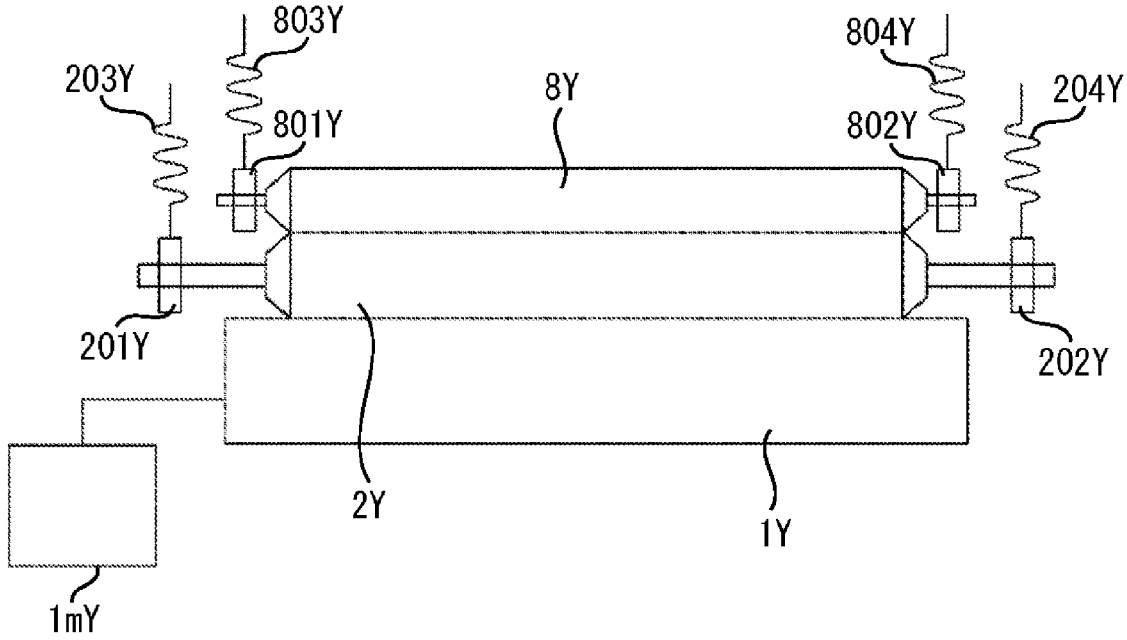
FIG. 3 is a schematic cross-sectional view illustrating a charging apparatus of the image forming portion.

FIG. 3 is an expanded view of the periphery of the charging roller 2Y of the image forming portion Pa. First, the drive mechanism of the charging roller 2Y as a first rotatable charging member will be described. Both ends of the shaft of the charging roller 2Y are supported by bearing members 201Y and 202Y. Springs 203Y and 204Y which are an urging member are respectively connected to these bearing members 201Y and 202Y to push the charging roller 2Y against the photosensitive member 1Y with a predetermined pressure. Thus, the charging roller 2Y is rotationally driven along with the rotation of the photosensitive member 1Y as the first photosensitive member.

The drive mechanism of the cleaning brush 8Y (driven mechanism) has bearing members 801Y and 802Y as a holding mechanism for supporting both ends of the shaft of the cleaning brush 8Y. Springs 803Y and 804Y which are urging members are respectively connected to these bearing members 801Y and 802Y so that the cleaning brush 8Y has a predetermined intrusion amount into the charging roller 2Y (in the present exemplary embodiment, 0.2 mm). Thus, the cleaning brush 8Y is rotationally driven along with the rotation of the charging roller 2Y. In other words, the cleaning brush 8Y rotates by obtaining a driving force from the charging roller 2Y via the brushes.

Therefore, the configuration of the cleaning brushes 8Y to 8C of the image forming portions Pa to Pc can be simplified by employing the driven mechanism as the drive mechanism. Namely, such a configuration can reduce the costs of the image forming portions Pa to Pc.

Figure 6:
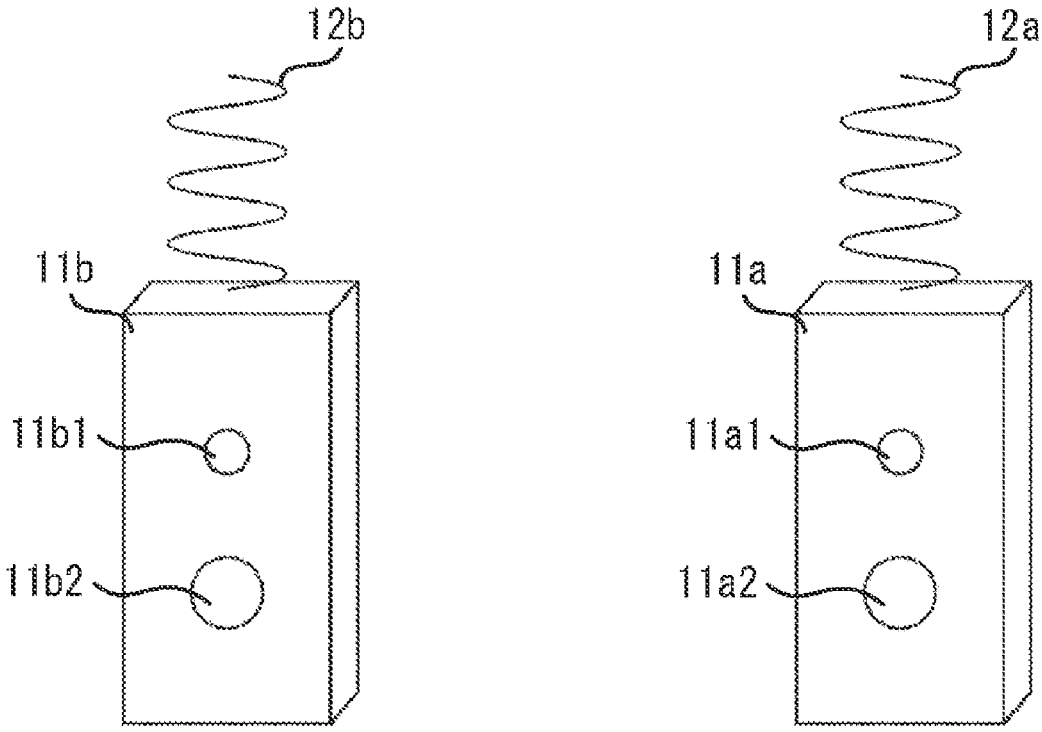
FIG. 6 is a schematic perspective view of a bearing member.

Next, using FIGS. 5 and 6, the drive mechanism (drive coupling mechanism) of the cleaning brush 8K of the image forming portion Pd will be described. FIG. 5 is an expanded view of the periphery of the charging roller 2K of the image forming portion Pd. Further, FIG. 6 is an expanded view of the bearing members which bear the charging roller 2K and the cleaning brush 8K.

In the present exemplary embodiment, the cleaning brush 8K is rotated in synchronization with the charging roller 2K by obtaining a driving force from the charging roller 2K without intervention of the brush. More specifically, in the drive mechanism of the cleaning brush 8K, the charging roller 2K which is rotatably driven along with the rotation of the photosensitive member 1Y as the second photosensitive member and the cleaning brush 8K are drivably coupled by a gear which is a drive coupling member. Therefore, the cleaning brush 8K rotates in synchronization with the charging roller 2K, but in the opposite direction to the charging roller 2K.

The charging roller 2K and the cleaning brush 8K are rotatably held by bearing members 11*a* and 11*b* which serve as a mechanism for fixing a distance between the respective shafts, at both ends in the longitudinal directions thereof. More specifically, both ends of the shaft of the charging roller 2K in the longitudinal direction are supported by bearing holes 11*a*2 and 11*b*2 of the bearing members 11*a* and 11*b*. On the other hand, both ends of the shaft of the cleaning brush 8K in the longitudinal direction are supported by bearing holes 11*a*1 and 11*b*1 of the bearing members 11*a* and 11*b*.

The bearing members 11*a* and 11*b* are respectively pressed towards the photosensitive member 1K by springs 12*a* and 12*b* while holding the charging roller 2K and the cleaning brush 8K.

Therefore, since the distance between the shafts of the charging roller 2K and the cleaning brush 8K can be constantly maintained, a state where the brush portion of the cleaning brush 8K intrudes by a predetermined amount into the charging roller 2K can be maintained. Further, in the present exemplary embodiment, to suppress permanent deformation of the brushes (fibers), the intrusion amount of the brushes (fibers) against the charging roller is set to 0.8 mm. The interval between the bearing holes 11*a*1 and 11*a*2 of the bearing member 11*a* is set such that this intrusion amount can be achieved. Further, similarly to the bearing member 11*a*, the interval between the two bearing holes 11*b*1 and 11*b*2 is set in the bearing member 11*b*.

Thus, by maintaining the intrusion amount of the brushes (fibers) against the charging roller 2K, the cleaning performance by the cleaning brush 8K can be maintained.

In addition, in the present exemplary embodiment, the charging roller 2K and the cleaning brush 8K are drivably coupled by the drive coupling mechanism in a position further outward in the longitudinal direction than the photosensitive member 1K on one end in the longitudinal direction thereof.

The drive coupling mechanism has a gear 21 (first gear) and a gear 81 (second gear) as drive coupling members which mesh (engage) with each other. The rotational driving force of the charging roller 2K is transmitted by these gears 21 and 81 in synchronization with the cleaning brush 8K.

More specifically, the rotational driving force from the charging roller 2K is transmitted to the cleaning brush 8K so that the rotation direction of the cleaning brush 8K and the rotation direction of the charging roller 2K are opposite. Stated another way, the rotational driving force from the charging roller 2K is transmitted to the cleaning brush 8K so that the cleaning brush 8K and the charging roller 2K are rotating in the same direction at the contact portion therebetween.

Therefore, even if the charging roller 2K slips against the photosensitive member 1K for some reason and the peripheral speed of the charging roller 2K fluctuates from the predetermined speed, the cleaning brush 8K can still follow the charging roller 2K and be rotated.

Therefore, a "relationship between the peripheral speed of the cleaning brush 8K and the peripheral speed of the charging roller 2K" which is preset so that the cleaning brush 8K can sufficiently exhibit the cleaning performance can be maintained. More specifically, since the charging roller 2K can be adequately cleaned by the cleaning brush 8K over a long period, the charging roller 2K can stably perform charging over along period. As a result, the problem of image density defects caused by faulty charging can be avoided.

Next, the peripheral speed ratio of the cleaning brush 8K with respect to the charging roller 2K and the cleaning results were verified for the cleaning brush 8K used in the present exemplary embodiment. The peripheral speed of the charging roller 2K refers to the moving speed of the outer peripheral surface thereof, and the peripheral speed of the cleaning brush 8K refers to the moving speed of the brush leading edge portion. In other words, for the cleaning brush 8K, angular frequency of the cleaning brush is changed and set so that the moving speed of the brush leading edge portion is at the speed to be set.

The peripheral speed of the cleaning brush 8K can be changed based on a number of teeth of the gears 21 and 81, and a desired peripheral speed ratio can be acquired based on that number of teeth.

Table 2 illustrates the cleaning state level of the charging roller 2K and whether an image defect occurred when the ratio of the peripheral speed of the cleaning brush 8K to the peripheral speed of the charging roller 2K was changed by 10% increments by changing the number of teeth of the gears 21 and 81.

In Table 2, in the column "Cleaning State of the Charging Roller", a cross (x) indicates a heavy level of dust, a circle (○) indicates that there is some dust, but not at a level which would cause problems in practical use, and a double circle (○○) indicates that there is no dust. Further, in the column "Occurrence of Image Defect", "yes" means that an image defect caused by faulty charging occurred, and "no" means that an image defect caused by faulty charging did not occur.

TABLE 2

| Peripheral Speed ratio of the Cleaning Brush to the Charging Roller | Cleaning State of the Charging Roller | Occurrence of Image Defect |
|---|---|---|
| 0.4 | x | YES |
| 0.5-0.8 | ○ | NO |
| 0.9-1.1 | ○○ | NO |
| 1.2-1.3 | ○ | NO |
| 1.4 | x | YES |

Thus, with respect to the configuration of the present exemplary embodiment, it is understood from the table that when the cleaning brush 8K is rotating in synchronization with the charging roller 2K at roughly an equal speed, the cleaning performance is high. More specifically, it can be understood that cleaning can be performed efficiently when the ratio of the peripheral speed of the cleaning brush 8K to the peripheral speed of the charging roller 2K is 0.9 or more to 1.1 or less.

This may be because if difference between the peripheral speed of the cleaning brush 8K and the peripheral speed of the charging roller 2K is large, the cleaning brush 8K conversely rubs dust onto the charging roller 2K. Based on these results, in the present exemplary embodiment, the ratio of the peripheral speed of the cleaning brush 8K to the peripheral speed of the charging roller 2K was set to 1.0.

Further, since an image defect does not occur if only a slight amount of dust is produced on the charging roller 2K, the ratio of the peripheral speed of the cleaning brush 8K to the peripheral speed of the charging roller 2K may be set to 0.5 or more to 1.3 or less. However, to perform charging stably over a long period without producing dust on the charging roller 2K, the ratio of the peripheral speed of the cleaning brush 8K to the peripheral speed of the charging roller 2K is desirably set to 0.9 or more to 1.1 or less.

As described above, by having such a configuration, a "relationship between the peripheral speed of the cleaning brush 8K and the peripheral speed of the charging roller 2K" which is predetermined such that the cleaning brush 8K can sufficient exhibit the cleaning performance, can be maintained.

Therefore, even if for some reason the charging roller 2K slips against the photosensitive member 1K and the peripheral speed of the charging roller 2K fluctuates from the predetermined speed, the cleaning brush 8K can still follow the charging roller 2K and be rotated.

Therefore, since the charging roller 2K can be adequately cleaned by the cleaning brush 8K over a long period, the charging roller 2K can stably perform charging over a long period. As a result, the problem of image density defects caused by faulty charging can be avoided.

Further, by setting the ratio of the peripheral speed of the cleaning brush 8K to the peripheral speed of the charging roller 2K to 0.9 or more to 1.1 or less, charging can be performed stably over a long period without producing dust on the charging roller 2K. Namely, such a ratio allows the charging roller 2K to have a longer life.

In conclusion, the image forming apparatus can be simplified by employing the driven mechanism as the drive mechanism for the cleaning brushes 8Y to 8C of the image forming portions Pa to Pc, and not employing the drive mechanism of the cleaning brush of the image forming portion Pd. Accordingly, the costs of the apparatus can be reduced compared with using in the image forming portions Pa to Pc the drive coupling mechanism which uses a gear like that of the image forming portion Pd.

Thus, to extend life, the drive mechanism which uses a gear as the cleaning brush drive mechanism is employed in the image forming portion (Pd) which uses a cleaning brush with a long brush length. On the other hand, in the image forming portions (Pa to Pc) which do not require a high level of life extension and which use cleaning brushes with a comparatively short brush length, the driven mechanism is employed in the cleaning brush drive mechanism.

As a result, charging can be performed stably over a long period at the image forming portion which uses a cleaning brush with a long brush length, and costs can be reduced in the image forming portions which uses cleaning brushes with a comparatively short brush length. In other words, present exemplary embodiment can reduce the costs while achieving an extended life of the apparatus.

Next, a configuration of a second exemplary embodiment will be described. Parts which are similar to the first exemplary embodiment are provided with the same reference numeral, and thus a detailed description of such parts will be omitted. In the present exemplary embodiment, an elastic rubber is used as the cleaning brush drive mechanism of the image forming portion Pd instead of the above-described gears 21Y and 81Y. The cleaning brushes of the image forming portions Pa to Pc and the drive mechanisms thereof are the same as in the first exemplary embodiment, and thus a detailed description of such parts will be omitted.

The drive mechanism of the cleaning brush 8K will be described.

Figure 7:
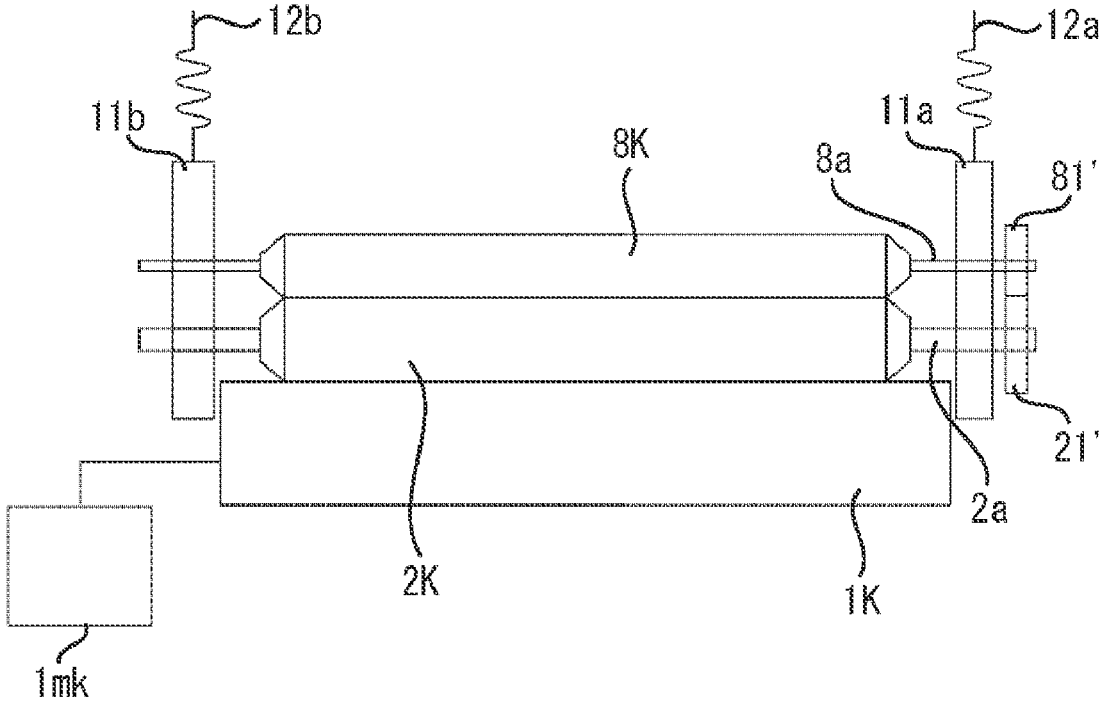
FIG. 7 is a schematic cross-sectional view illustrating a charging apparatus of the image forming portion.

As illustrated in FIG. 7, as the drive mechanism of the cleaning brush 8K, elastic, cylindrical solid rubber pieces 21' and 81' are respectively fixed to the shafts of the charging roller 2K and the cleaning brush 8K. These cylindrical rubber pieces 21' and 81' are also referred to as friction wheels.

These cylindrical rubber pieces 21' and 81' are configured so as to strongly press against each other. Therefore, when the charging roller 2K rotates, a rotational driving force from the cylindrical rubber piece 21' is transmitted to the cylindrical rubber piece 81' without slippage, and the cleaning brush 8K rotates in synchronization with the rotation of the charging roller 2K in the driven direction.

In the present exemplary embodiment, by setting the ratio of the peripheral speed of the cleaning brush 8K to the peripheral speed of the charging roller 2K to 0.9 or more to 1.1 or less, charging can be performed stably over a long period without producing dust on the charging roller 2K. Thus, the charging roller 2K can have a longer life.

Thus, in the present exemplary embodiment too, the "relationship between the peripheral speed of the cleaning brush 8K and the peripheral speed of the charging roller 2K" which is predetermined such that the cleaning brush 8K can sufficient exhibit the cleaning performance can be maintained.

Therefore, even if for some reason the charging roller 2K slips against the photosensitive member 1K, so that the peripheral speed of the charging roller 2K fluctuates from the predetermined speed, the cleaning brush 8K, can still follow the charging roller 2K and be rotated.

Therefore, since the charging roller 2K can be adequately cleaned by the cleaning brush 8K over a long period, the charging roller 2K can stably perform charging over a long period. As a result, the problem of image density defects caused by faulty charging can be avoided.

However, considering drive transmission reliability, the drive coupling mechanism which uses a gear described in the first exemplary embodiment is better than the drive coupling mechanism which uses a cylindrical rubber piece (friction wheel).

While in the above first and second exemplary embodiments, examples were described in which a gear or a friction wheel is used as the drive coupling mechanism, the present invention is not limited to such examples. For instance, an endless belt which functions as the drive coupling member may be provided in the shape of an "8" around the shafts of the charging roller 2K and the cleaning brush 8K for performing the drive coupling/drive transmission therebetween. In such a configuration, to prevent the endless belt from slipping, it is desirable to perform a high-friction treatment on a portion of the shaft of either the charging roller 2K or the cleaning brush 8K which is in contact with the endless belt.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-210762 filed Aug. 19, 2008, which is hereby incorporated by reference herein in its entirety.

What is claimed is:

1. An image forming apparatus comprising:

a first image forming portion including a first photosensitive member, a first charging member configured and positioned to electrically charge the first photosensitive member to form an image on the first photosensitive member, and a first cleaning brush configured and positioned to clean the first charging member;

a second image forming portion including a second photosensitive member, a second charging member configured and positioned to electrically charge the second photosensitive member to form an image on the second photosensitive member, and a second cleaning brush which has a longer brush length than a brush length of the first cleaning brush configured and positioned to clean the second charging member;

a driven mechanism configured to cause the first cleaning brush to be rotatably driven by the first charging member which is rotatably driven along with rotation of the first photosensitive member; and a drive coupling mechanism configured to drivably couple the second charging member and the second cleaning brush to transmit a driving force from the second charging member which is rotatably driven along with the rotation of the first photosensitive member to the second cleaning brush.

2. The image forming apparatus according to claim 1, wherein the drive coupling mechanism transmits the driving force to the second cleaning brush so that second cleaning brush rotates in an opposite direction to the second charging member.

3. The image forming apparatus according to claim 1, wherein the driven mechanism comprises a holding mechanism configured to rotatably hold the first cleaning brush so that the first cleaning brush can intrude into the first charging member by a predetermined amount, and wherein the drive coupling mechanism comprises a first gear arranged on a shaft of the second charging member, and a second gear which is arranged on a shaft of the second cleaning brush and engages with the first gear.

4. The image forming apparatus according to claim 1, wherein the first image forming portion is configured to form a chromatic image, and the second image forming portion is configured to form an achromatic image.

* * * * *